United States Patent [19]

Hope et al.

[11] 4,302,163

[45] Nov. 24, 1981

[54] ADJUSTABLE OUTPUT PUMP FOR LIQUIDS

[76] Inventors: Henry F. Hope; Stephen F. Hope, both of 2421 Wyandotte Rd., Willow Grove, Pa. 19090

[21] Appl. No.: 89,521

[22] Filed: Oct. 30, 1979

[51] Int. Cl.[3] ..... F04B 43/08; F01B 19/04; F04B 49/00

[52] U.S. Cl. ..... 417/473; 417/539; 92/13.2; 92/13.7; 74/571 L

[58] Field of Search ..... 74/571 R, 571 L; 92/13.2, 13.7; 417/472, 473

[56] References Cited

U.S. PATENT DOCUMENTS

| | | | |
|---|---|---|---|
| 1,565,819 | 12/1925 | Saunders | 92/13.7 |
| 1,907,647 | 5/1933 | Gruman | 74/571 L |
| 2,594,836 | 4/1952 | Wunderlich et al. | 74/571 L |
| 3,529,908 | 9/1970 | Smith | 417/472 |
| 3,798,996 | 3/1974 | Kirschmann | 74/571 L |

FOREIGN PATENT DOCUMENTS

| | | | |
|---|---|---|---|
| 163254 | 10/1948 | Austria | 74/571 L |
| 905426 | 9/1962 | United Kingdom | 92/13.2 |

*Primary Examiner*—William L. Freeh

*Attorney, Agent, or Firm*—Zachary T. Wobensmith, 2nd; Zachary T. Wobensmith, III

[57] ABSTRACT

An adjustable expansible chamber pump for liquids is disclosed, which is resistant to corrosion and which preferably utilizes a compressible bellows of synthetic plastic material, which is compact, which has improved expansible chamber actuating mechanism comprising an adjustable eccentric driving member to vary the stroke to adjust the quantity of liquid delivered, the adjustment of the eccentric being easily accomplished and the setting being visible and approaching linearity and adapted for delivery of small quantities of a specific component, the pump being readily employed with similar pumps for simultaneous or staggered pumping of a plurality of liquids for mixing and which can utilize a single driving motor.

14 Claims, 12 Drawing Figures

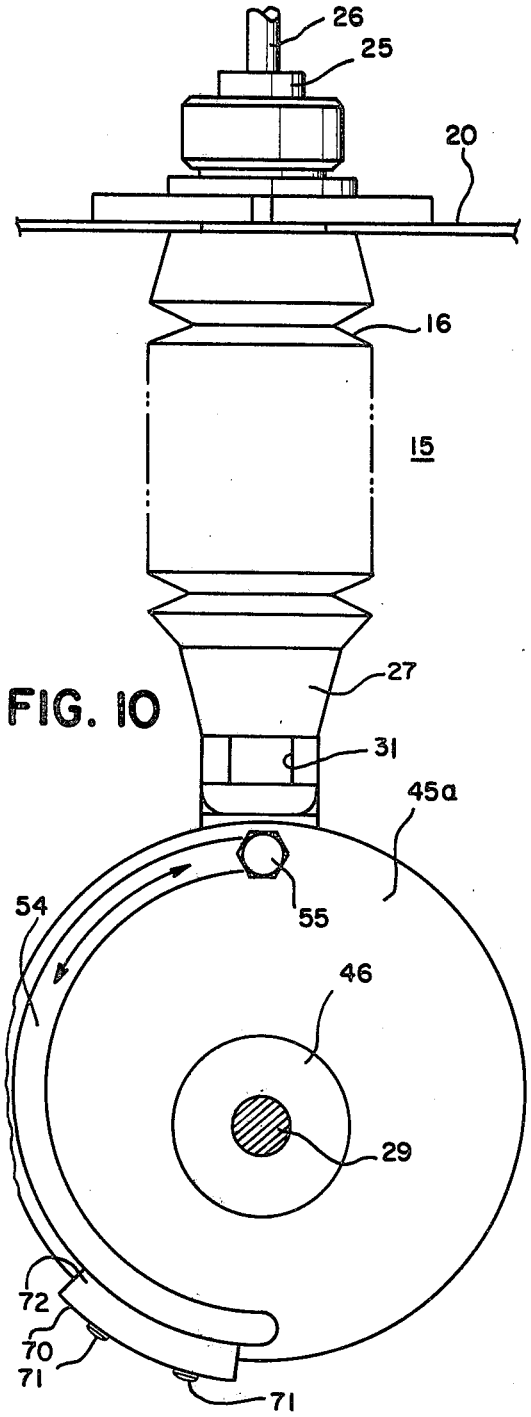
FIG. 10
FIG. 11
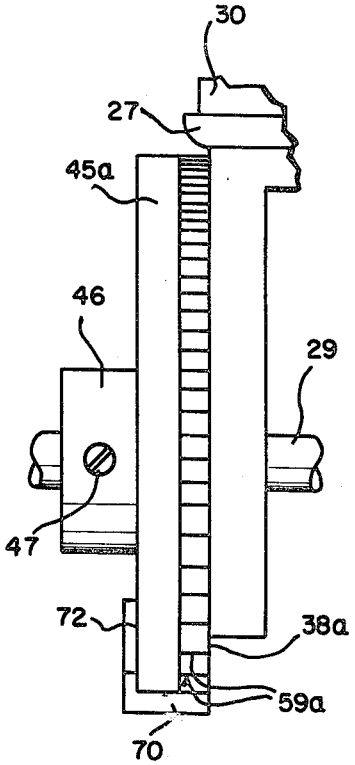

ADJUSTABLE OUTPUT PUMP FOR LIQUIDS

BACKGROUND OF THE INVENTION

1. Field of the Invention

This invention relates to adjustable output pumps for liquids.

2. Background of the Prior Art

It has heretofore been proposed to provide adjustable output pumps of the expandible chamber type employing bellows, diaphragms or pistons.

It has also heretofore been proposed to provide bellows pumps such as are shown in the U.S. Patents to Geisler, No. 1,454,886, and Fowler, No. 2,553,247 which have eccentric drives.

In the U.S. Patents to Bennett, No. 2,975,599 and Fazakes, No. 4,031,778 adjustable eccentrics are shown in which the adjustment of eccentricity is by a diametrical shift, while in the U.S. Patent to Mattox, No. 2,254,539 an adjustable lever or rocker arm with a limiting set screw is provided actuated by a cam to vary the stroke of the lever.

Most of the bellows heretofore employed in pumps were of metal which is not suitable for use with liquids containing chemicals or which otherwise can cause corrosion. The U.S. Patents to Smith, No. 3,529,908 and Mondaidis, No. 3,376,868 show pump bellows of resilient elastomeric material having a high elastic recovery such as polypropylene. The U.S. Patent to Laerdal, No. 3,363,833 shows a pump bellows of rubber, natural or synthetic.

In some of the bellows pumps heretofore available the resiliency of the bellows was relied upon on the suction stroke for restoring the bellows to its precompressed condition.

In most of the pumps including bellows pumps, diaphragm pumps and piston pumps for pumping small quantities of liquids heretofore proposed by others, the structures are complex and expensive to construct, usually require assembly and replacement of components to be made by the manufacturer or in the shop, are not suited for easy adjustment of the stroke and are subject to corrosion by the liquid to be pumped.

SUMMARY OF THE INVENTION

In accordance with the invention an adjustable output expansible chamber pump for liquids is provided, preferably of the bellows type having a removable expansible and compressible chamber which may be a molded synthetic plastic corrosion resistant unit and which may have one end threaded for the attachment of a valve chamber with inlet and delivery valves therein, an adjustable multi-part eccentric driving member being provided to control the length of the stroke, preferably with visible indication of the setting.

The parts of the pump exposed to liquid are advantageously of synthetic plastic materials which are not affected by the liquid being pumped and the pump is light in weight. A plurality of pumps can be disposed side to side and driven by a common shaft from a single motor.

It is the principal object of the invention to provide an adjustable output expansible chamber pump for liquids which has an adjustable eccentric drive, which is simple in construction, free from likelihood of corrosion by the liquids being pumped, which will have a long life and which can be inexpensively made.

It is a further object of the invention to provide an adjustable output pump for liquids having an eccentric drive which can be quickly and easily adjusted to change the output and which is substantially linear in its adjustment.

It is a further object of the invention to provide an adjustable output pump for liquids which has an adjustable eccentric drive with readily visible indication of the setting thereof.

It is a further object of the invention to provide an adjustable pump for liquids having an eccentric drive which has plate members readily movable for adjustment of the eccentricity and which are clamped in the desired position of adjustment.

It is a further object of the invention to provide an adjustable pump for liquids having an eccentric drive and which includes an eccentric member swingable with respect to a drive shaft for change in the length of the pump stroke.

It is a further object of the invention to provide an adjustable pump for liquids having a readily accessible and adjustable eccentric drive which can be varied over a wide range of adjustment.

It is a further object of the invention to provide an adjustable pump for liquids and in which a plurality of pumps of the same type and driven from a common shaft can have one pump set for full capacity delivery of liquid and another set for a very minute delivery of liquid for mixing in accordance with the formulation desired.

It is a further object of the invention to provide an adjustable pump for liquids having an eccentric drive made of relatively simple parts which can be easily assembled.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which:

FIG. 10 is a side elevational view of the pump of FIG. 8 as seen from the opposite side;

FIG. 11 is a rear elevational view of the adjustable eccentric shown in FIG. 9.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Figure 1:
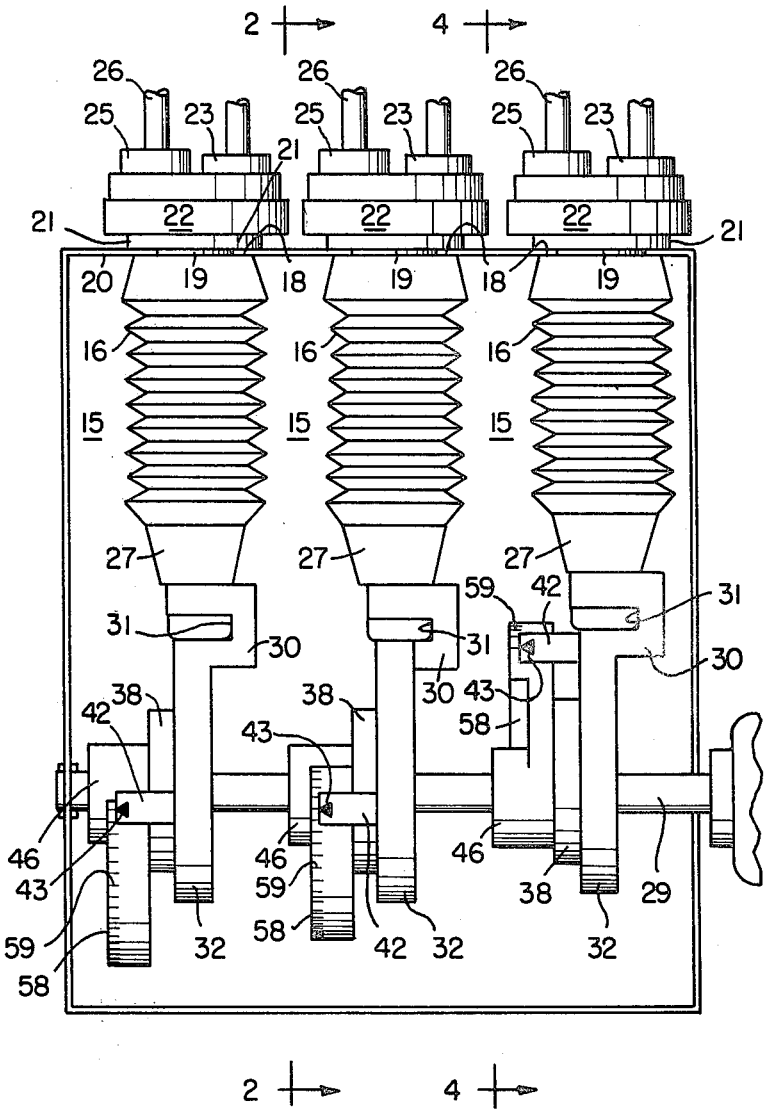
FIG. 1 is a front elevational view of one preferred embodiment of the invention and showing a plurality of adjustable pumps for liquids, shown at different positions of adjustment.
Figure 2:
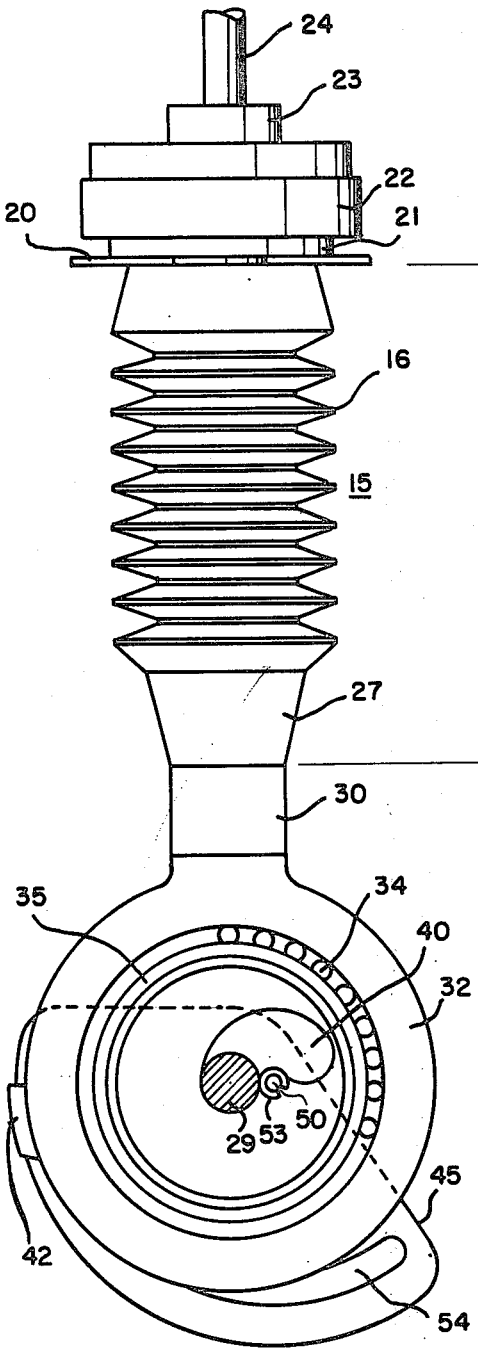
FIG. 2 is a side elevational view of one of the pumps taken approximately on the line 2—2 of FIG. 1 and showing one position of adjustment.
Figure 3:
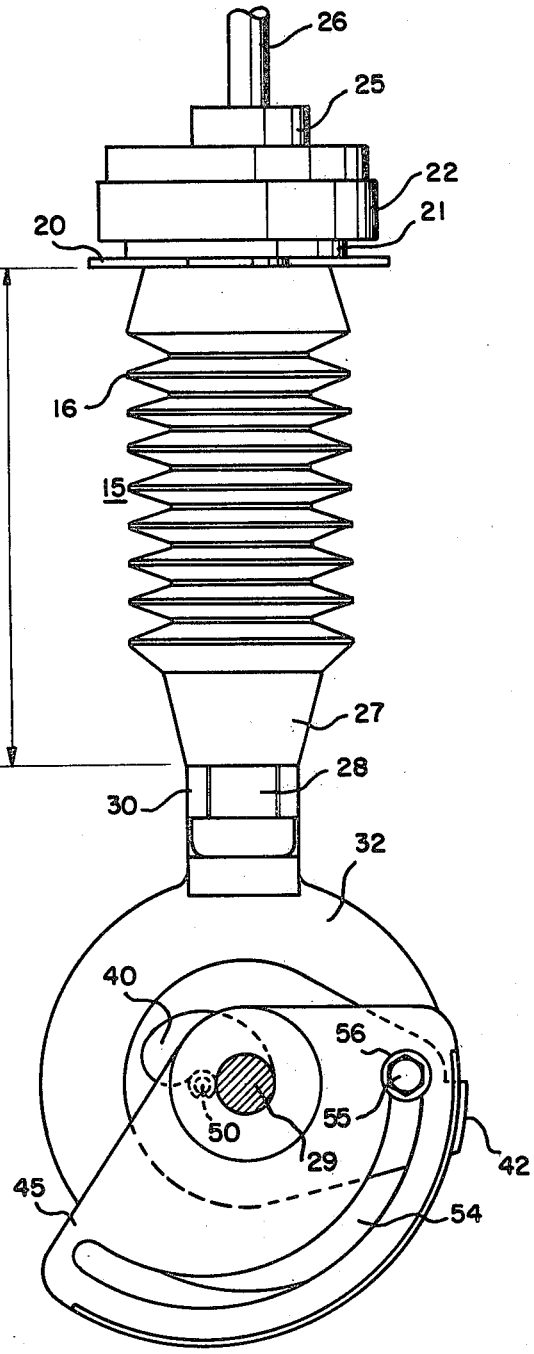
FIG. 3 is a side elevational view of the pump of FIG. 2 as seen from the side opposite that of FIG. 2.
Figure 4:
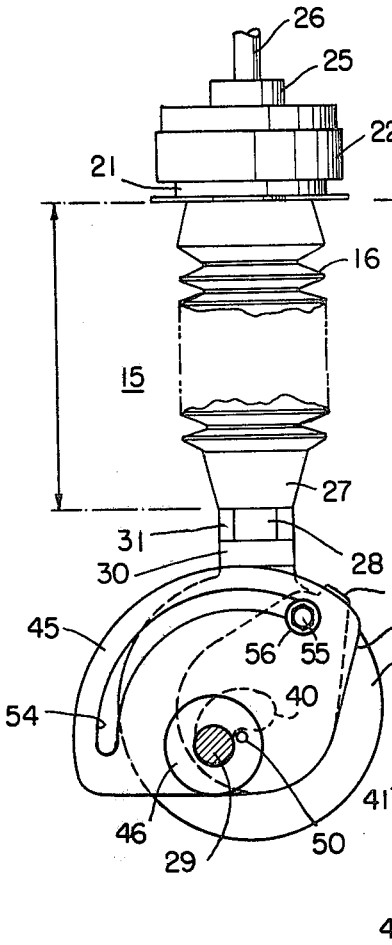
FIG. 4 is a side elevational view of another of the pumps taken approximately on line 4—4 of FIG. 2 and showing another position of adjustment.
Figure 5:
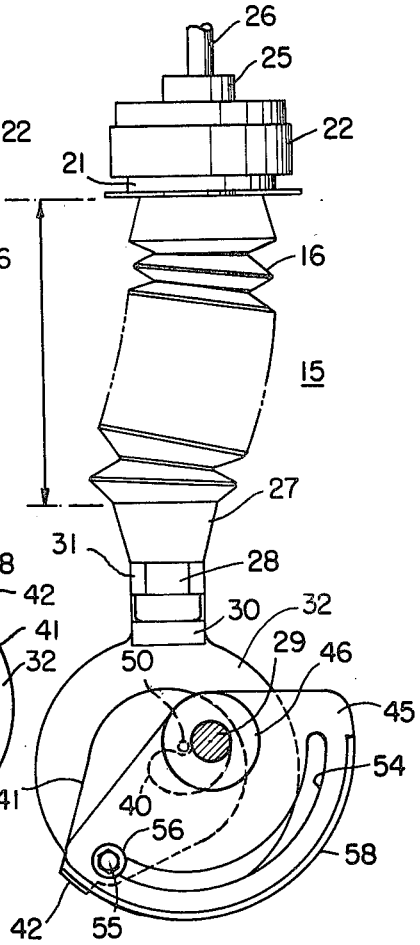
FIG. 5 is a side elevational view of the pump of FIG. 4 at a different portion of its stroke.
Figure 6:
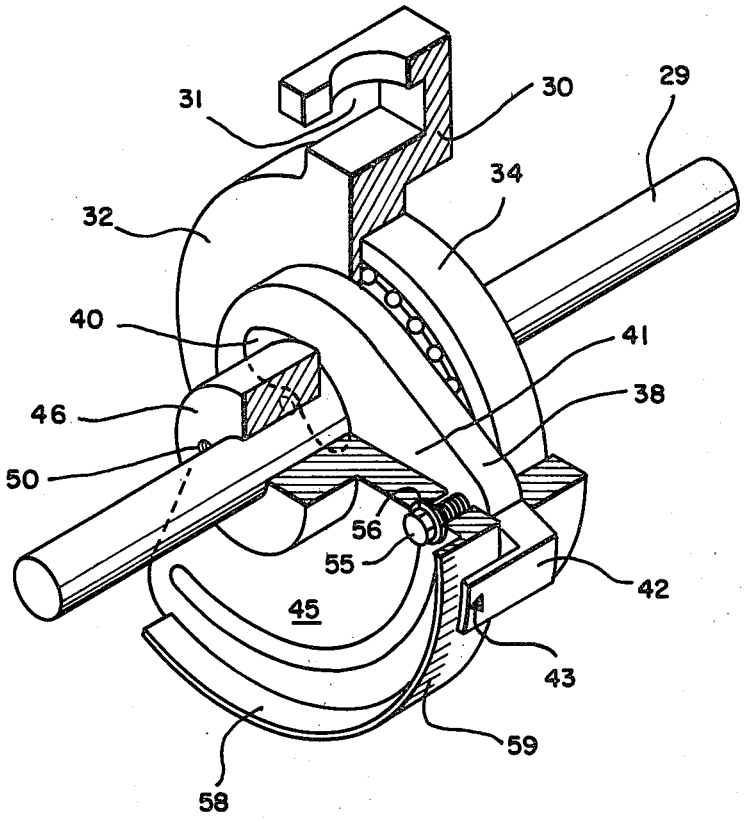
FIG. 6 is a view in perspective of the eccentric drive, parts being broken away to show the details of construction.
Figure 7:
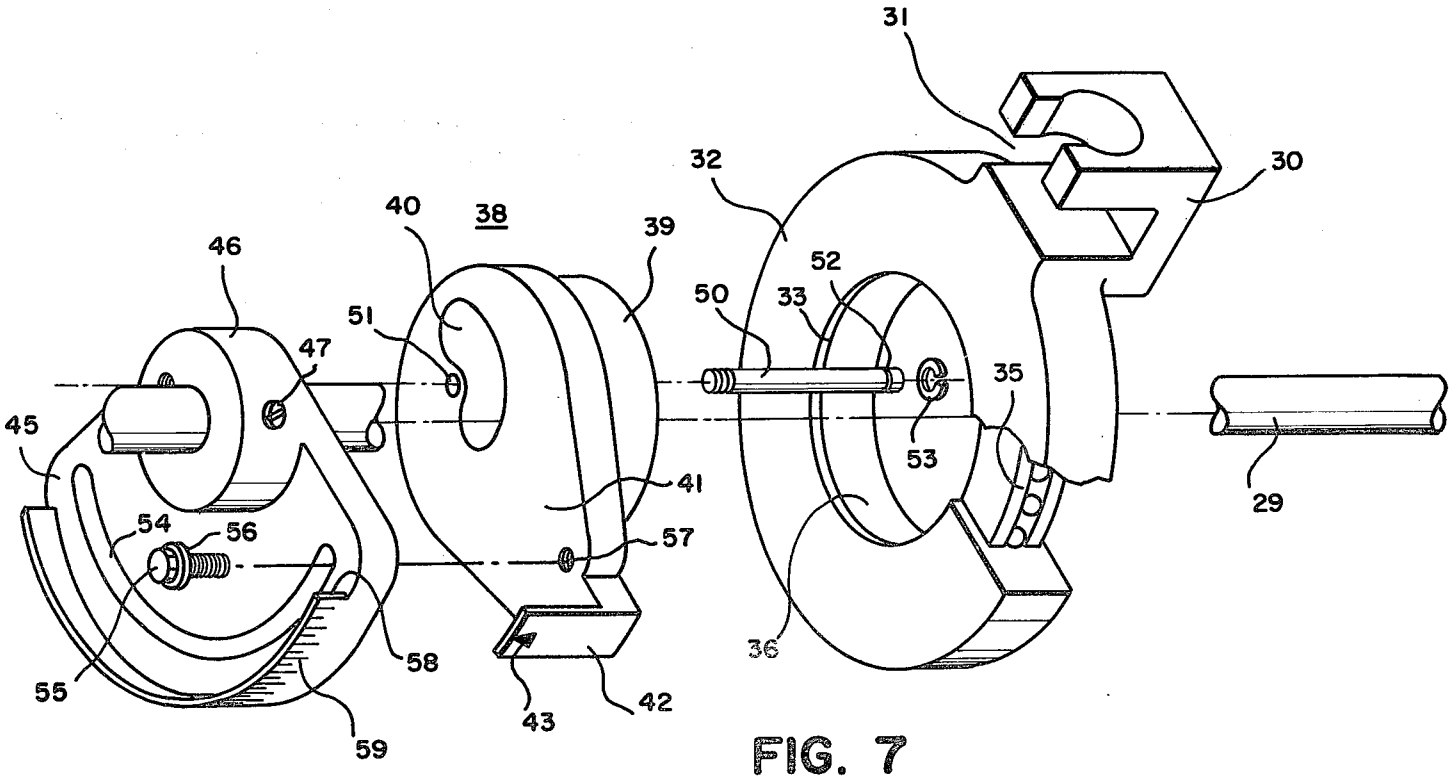
FIG. 7 is an exploded view of the adjustable eccentric of FIGS. 1 to 6, inclusive.

Referring now more particularly to FIGS. 1 to 6, inclusive, the adjustable pump there illustrated includes an expansible chamber, preferably a flexible bellows 15, molded in one piece of resilient elastomeric material.

The bellows 15 has an expansible and contractible continuous cylindrical corrugated side wall portion 16 with alternate ridges. and grooves in parallel planes and mounting and valve housing attaching neck portion which includes an upper flat face 18 with a neck 19 extending thereabove for reception in a fixed horizontal frame plate 20 forming part of the mounting frame (not shown). A clamp 21 on the neck 19 retains the bellows 15 in fixed position with respect to the frame plate 20.

The neck 19 has mounted therein a valve housing 22 with an inlet valve chamber 23 having a liquid inlet pipe 24 and a delivery valve chamber 25 having a liquid delivery pipe 26. The chambers 23 and 25 have valves (not shown) therein of any desired type.

The bellows 15 has a closed frusto-conical lower end closure portion 27 with a groove 28 for clamping.

A main drive shaft 29 is provided driven in any desired manner such as by a motor (not shown) and in either direction of rotation.

A connecting member or yoke 30 is provided having a transverse slot 31 for reception of the grooved end closure portion 27. The yoke 30 has a ring portion 32 with a central opening 33. The ring portion 32 has bearing 34 mounted therein, preferably of the ball bearing type, with an inner race 35 of the bearing 34 having an interior cylindrical face 36. The use of a ball bearing in the yoke 30 reduces the side loading of the yoke 30.

A cam 38 having a hub 39 is secured in engagement with the face 36 of the inner bearing race 35, preferably with a forced fit.

The cam 38 has a C-shaped curved slot 40 through which the drive shaft 29 extends for adjustment, the shaft 29 preferably lightly touching opposite side faces of the slot 40. The cam 38 also has an outward extension 41 with an offset end 42 carrying an indicating pointer 43.

An adjusting plate 45 preferably has a hub 46 which is secured to the drive shaft 29 by a set screw 47.

The adjusting plate 45 has threaded therein in an opening 44, in spaced relation to the shaft 29, a pivot pin 50, for pivotal mounting of the cam 38, which extends through an opening 51 in the cam 38 and has a groove 52 for engagement by a spring washer 53 to retain the cam 38 and adjusting plate 45 in assembled relation.

The adjusting plate 45 has an arcuate slot 54, concentric with the shaft 27 for the reception of a clamping bolt 55 with a washer 56 thereon. The bolt 55 engages in a threaded opening 57 in the cam 38 to hold the adjusting plate 45 and cam 38 at the desired position of adjustment. The adjusting plate 45 has an arcuate flange 58 with indicia 59 thereon, the flange 58 being movable with respect to the pointer 43 to indicate the adjusted position. The indicia 59 can be calibrated as desired and in a specific instance each space between lines may indicate one cubic centimeter.

The eccentric drive may be adjusted from a minimum which may be zero stroke to a maximum by relative movement of the cam 38 with respect to the adjusting plate 45, the clamping bolt 55 being loosened for this purpose. The cam 38 is rotatable about the pivotal axis provided by the pivot pin 50, to position the slot 54 with respect to the shaft 27. At one end of the slot 54 the stroke will be a zero position and at the opposite end the stroke will be at a maximum.

The adjusting plate 45 and the cam 38 are clamped at the desired position of adjustment by tightening the clamping bolt 55.

The mode of operation will now be pointed out.

Upon rotation of the drive shaft 29 the bellows 15 will be alternately contracted and expanded by movement of the yoke 30, the length of the stroke being determined by the setting of the cam 38 with respect to the adjusting plate 45. The setting can be varied as desired over a wide range from zero to a maximum determined by the length of the slots 40 and 54. The variation in setting can be of a very small order and with a plurality of pumps driven by a common shaft.

When a plurality of pumps are driven from the same shaft 29 it is desirable to mount the cams so that their compression strokes are distributed around the shaft 20 to reduce peak loading on the driving motor.

Figure 8:
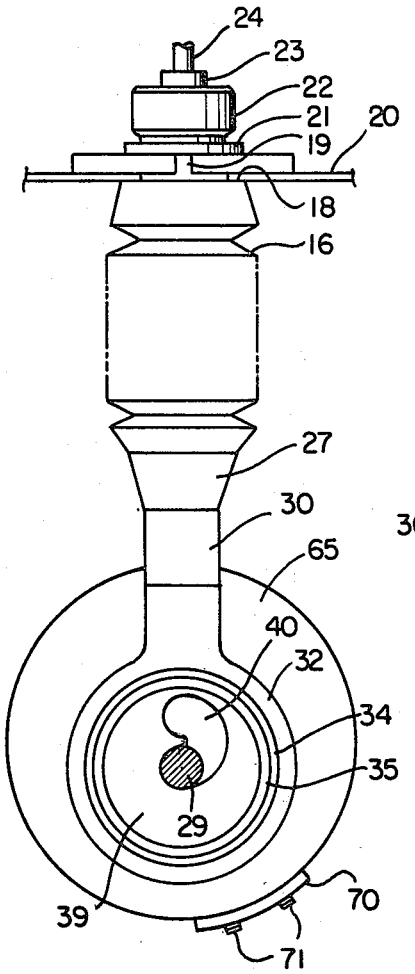
FIG. 8 is a side elevational view of another preferred embodiment of the invention having a different adjustable eccentric drive.
Figure 9:
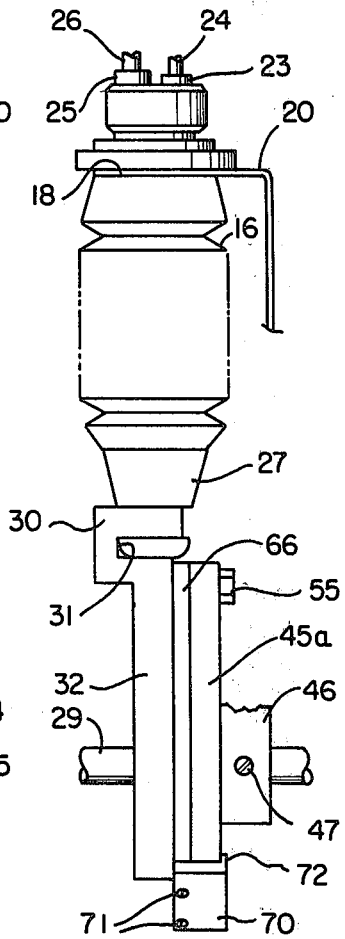
FIG. 9 is a front elevational view of the pump shown in FIG. 8.
Figure 12:
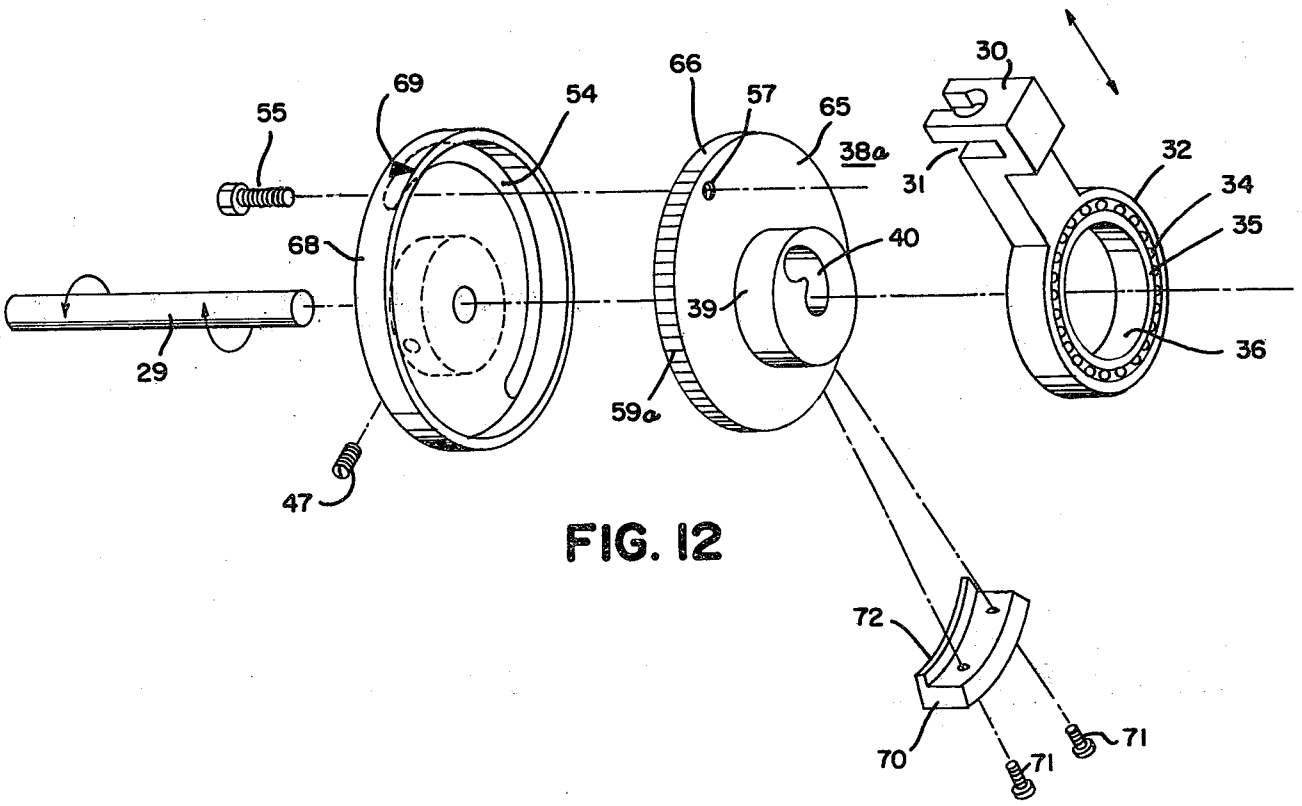
FIG. 12 is an exploded view of the adjustable eccentric of FIGS. 8 and 11, inclusive.

Referring now to FIGS. 8 to 12, inclusive, another preferred form of adjustable driving eccentric is there shown.

A yoke 30 is provided as before for connection at its slot 31 to the lower end closure 27 of the bellows 15. The yoke 30 has a ring portion 32, with a bearing 34, an inner race 35 and an inner face 36 for engagement, preferably with a force fit, of the hub 39 of a cam 38*a*. The cam 38*a* has a C-shaped slot 40 through which the shaft 29 extends.

The cam 38*a* has an outwardly extending circular disc 65 and which may have stroke length indicating indicia 59*a* on its rim 66.

An adjusting plate 45*a* in the form of a disc 67 is provided having a rim 68. The rim 68 may have a pointer 69 thereon. The adjusting plate 45*a* has a hub 46 through which the shaft 29 extends, the hub 46 being secured to the shaft 29 by a set screw 47. The adjusting plate 45*a* has an arcuate slot 54 for adjustment of the position of the cam 38*a* and a bolt 55 extends through the slot 54 and engages in a threaded opening 57 in the cam disc 65. The cam 38*a* can be turned relative to the plate 45*a* and locked in the desired position of adjustment by tightening the bolt 55.

A bracket 70 secured on the periphery of the adjusting plate 45*a* by screws 71 has a rim portion 72 which prevents undesired separation of the cam 38*a* and the adjusting plate 45*a*.

The length of the stroke may be adjusted by loosening the bolt 55 and turning the cam 38*a* to the desired position of adjustment.

The mode of operation of the pump, after the desired stroke setting has been achieved is like that previously described.

It will thus be seen that simple adjustable pumps have been provided with simple and readily adjustable cam driving devices for expansible chamber pumps, and with readily accessible indication of the stroke length setting.

We claim:

1. An adjustable stroke liquid pump comprising
a pump having expansible chamber means with liquid inlet and delivery valves, and
variable stroke means for varying the delivery of liquid from said expansible chamber means,
said variable stroke means comprising
a rotatable drive shaft,
a connecting member actuating said expansible chamber means and having a central axial opening,
an eccentric cam member disposed in said opening and an adjustment plate member on said shaft in facing relation to said cam member,
said cam member and said plate member being relatively rotatable for adjusting of the stroke,
said adjustment plate member being secured to said shaft,
said cam member being rotatably mounted in said opening and with respect to said connecting member and having an arcuate slot for movement of said cam member with respect to said shaft for stroke variation, and
means for locking said cam member and said plate member in a selected position of adjustment.

2. The combination defined in claim 1 in which
said expansible chamber means comprises a bellows.

3. The combination defined in claim 1 in which
said cam member is pivotally connected to said plate member.

4. The combination defined in claim 1 in which
said means for locking said cam member and said plate member comprises an arcuate slot in said plate member at a greater distance from said shaft than said arcuate slot in said cam member.

5. The combination defined in claim 1 in which
said means for locking said cam member and said plate member comprises
an arcuate slot in one of said members, and
a bolt extending through said slot and in engagement with the other of said members.

6. The combination defined in claim 1 in which
an additional pump is provided contiguous to said first pump, and
said additional pump is driven by said rotatable drive shaft.

7. The combination defined in claim 1 in which
said arcuate slot is disposed to provide a zero stroke set position.

8. The combination defined in claim 1 in which
said arcuate slot permits of selective setting for any desired pump output within its range.

9. The combination defined in claim 1 in which
indicating means is provided for indicating the stroke setting.

10. The combination defined in claim 1 in which
indicating means is provided for indicating the stroke setting of said cam member and said plate member comprising
a pointer member on one of said members, and
spaced volume output indicia on the other of said members.

11. The combination defined in claim 1 in which
said connecting means is provided with a bearing in which said cam member is carried.

12. The combination defined in claim 1 in which
said cam member and said plate member have a bracket carried by one of said members with a portion in engagement with the side face of the other of said members.

13. The combination defined in claim 1 in which
said arcuate slot has the inner and outer walls thereof in engagement with said drive shaft.

14. An adjustable stroke liquid pump comprising
a pump having expansible chamber means with liquid inlet and delivery valves, and
variable stroke means for varying the delivery of liquid from said expansible chamber means,
said variable stroke means comprising
a rotatable drive shaft,
a connecting member actuating said expansible chamber means,
a cam member and an adjustment plate member on said shaft in facing relation,
said cam member and said plate member being relatively rotatable for adjustment,
said plate member being secured to said shaft,
said cam member being rotatably mounted with respect to said connecting member and having an arcuate slot for movement of said cam member with respect to said shaft for stroke variation, and
means for locking said cam member and said plate member in a selected position,
said plate member having a pin extending therefrom on which said cam member is pivotally mounted.

* * * * *

UNITED STATES PATENT AND TRADEMARK OFFICE

CERTIFICATE OF CORRECTION

PATENT NO. : 4,302,163

DATED : NOVEMBER 24, 1981

INVENTOR(S) : HENRY F. HOPE and STEPHEN F. HOPE

It is certified that error appears in the above—identified patent and that said Letters Patent is hereby corrected as shown below:

Column 1,

Line 10, "expandible" should be - expansible -.

Column 3,

Line 4, "and" should be - to -.

Column 4,

Line 13, after "be" insert - at -.

Column 5,

Line 19, "adjusting" should be - adjustment -.

Column 6,

Line 17, "means" should be - member -.

Signed and Sealed this

*Ninth* Day of *February 1982*

[SEAL]

*Attest:*

GERALD J. MOSSINGHOFF

*Attesting Officer*

*Commissioner of Patents and Trademarks*